United States Patent [19]

Hall

[11] Patent Number: 4,894,023

[45] Date of Patent: Jan. 16, 1990

[54] CONNECTOR ASSEMBLY FOR ANODE RING OF CATHODE RAY TUBE

[76] Inventor: Harold E. Hall, 14767 Madison Rd., Middlefield, Ohio 44062

[21] Appl. No.: 240,683

[22] Filed: Sep. 6, 1988

[51] Int. Cl.[4] ..... H01R 13/52

[52] U.S. Cl. ..... 439/278; 439/492; 439/588

[58] Field of Search ..... 439/278–280, 439/492, 588, 636, 909

[56] References Cited

U.S. PATENT DOCUMENTS

| | | | |
|---|---|---|---|
| 2,719,956 | 10/1955 | Leighton | 439/278 |
| 3,258,732 | 6/1966 | Martin | 339/59 |
| 3,267,472 | 8/1966 | Rosenberg et al. | 339/223 |
| 3,486,162 | 12/1969 | Leitman | 439/278 |
| 3,587,034 | 6/1971 | Canell | 339/102 |
| 3,783,432 | 1/1974 | Biba et al. | 339/12 V |
| 4,155,614 | 5/1979 | Hall | 339/60 R |
| 4,204,741 | 5/1980 | Hall | 439/278 |
| 4,382,650 | 5/1083 | Herrmann, Jr. | 439/278 |
| 4,555,155 | 11/1985 | Drake | 439/492 |
| 4,566,746 | 1/1986 | Hobson | 439/588 |
| 4,582,388 | 4/1986 | Swaffield | 439/909 |

FOREIGN PATENT DOCUMENTS 1260637 2/1968 Fed. Rep. of Germany ..... 439/588

*Primary Examiner*—P. Austin Bradley

*Attorney, Agent, or Firm*—Body, Vickers & Daniels

[57] ABSTRACT

An improved anode cup or connector assembly for a cathode ray tube comprises a one-piece, generally U-shaped sheet metal connector clip snugly fitted and rigidly supported and locked in place in a cavity in a skirted resilient rubber-like cap, the clip having side-by-side mounting legs protruding from an open end of the cavity into the skirt of the cap and provided with catch lugs for insertion into and locking engagement with a standard hollow anode button embedded in the tube wall to mount the anode cup in place thereon. A bared wire end of an insulation sheathed anode supply conductor extends into the cap cavity through a passageway thereinto within a laterally extending barrel portion of the cap, and it extends between the legs of and is electrically connected to the clip by bending of a pinch plate on the clip to clamp the bared wire end between the pinch plate and a grip tab on the base end of the clip. Spring tangs on the clip legs snap lock behind the bent pinch plate to lock it in wire clamping position.

67 Claims, 5 Drawing Sheets

CONNECTOR ASSEMBLY FOR ANODE RING OF CATHODE RAY TUBE

This application relates to improvements with respect to the connector assemblies shown in my U.S. Pat. Nos. 4,155,614 and 4,204,741.

This invention relates to the art of electrical connectors, and more particularly to an electrical connector for connecting a high voltage power supply to a standard anode ring or button which is embedded in the envelope of a cathode ray tube.

Background of the Invention

Cathode ray tubes, such as television display tubes, typically have an electrically conductive metal ring or button embedded in the side wall of the envelope for conducting the anode voltage to the inside of the tube. The button is in the shape of an outwardly facing cup having an annular flange extending inwardly around its outer rim creating parallel inner and outer surfaces which lie in turn parallel to the inner and outer wall surfaces of the cathode ray tube envelope. The standard anode buttons commonly in use at present, however, are not opaque to the transmission to the outside of the tube of X-rays generated inside the tube. A grounded shield in the form of a metal coating encases the tube except for a small insulating spacing around the anode button.

Electrical connectors heretofore commonly employed for connecting high voltage anode supply conductors to such standard anode buttons of cathode ray tubes have generally comprised a resilient dish-like cap or cup of rubber or rubber-like material having a head portion with a flared out skirt portion and supporting therein a metal clip member having mounting legs extending outwardly of the head portion and within the confines of the skirt portion of the cap for engagement of hook ends of the mounting legs under the anode button flange when the cap is flattened against the outer wall surface of the cathode ray tube envelope, thereby to hold the connector in place on the tube due to the resiliency and biasing force of the flexed cap. The anode supply conductor extends through a side passageway leading into the head portion of the cap through a laterally extending barrel portion thereof and it terminates in the cap in a bared wire end which is suitably electrically connected to the metal clip supported in the cap.

In one manufacturing procedure heretofore widely employed to fabricate anode connector assemblies such as described above, the anode supply conductor is first electrically connected to the metal clip, as by soldering or otherwise connecting the bared wire end of the conductor to the metal clip, to form a subassembly thereof. This subassembly is then assembled with the resilient cap by inserting the free end of the conductor wire inwardly into the clip receiving cavity of the cap and then pushing it into and pulling it out through the side passageway in the cap while at the same time guiding the attached metal clip into and properly seating it in supported position within the clip receiving cavity of the cap. The yieldable elastic nature of the cap enables this type of assembly. This manner of assembly, however, is not only tedious and time consuming, but also imposes undesirable stresses on the soldered or other type connection between the clip and conductor which may possibly cause damage or weakening thereof such as can affect the structural integrity of the connection and/or the ability for the clip to firmly interengage with the anode button against unintended disengagement therefrom. Any separation of the clip and anode button is undesirable in that it can result in increased X-ray radiation. Moreover, it will be appreciated that a connection between the bared conductor wire end and clip provided by solder or the like, whether or not weakened during the assembly with the cap as described above, is subject to being fractured or completely broken by a person jerking on the high voltage anode supply conductor leading to the cap, in an effort to remove the connector assembly from the cathode ray tube. Any such fracture of the connection of course can affect electrical continuity, and any separation of the conductor and clip of course requires replacement of the connector assembly.

A well known alternative procedure for fabricating anode connector assemblies such as described above and which avoids the above referred to tedious and time consuming assembly with the cap of a preliminarily fabricated subassembly of the connector wire and metal clip, allows the electrical connecting in a suitable manner of the conductor wire to the metal clip in situ in the cavity of the resilient cap. Thus, as disclosed in the above referred to U.S. Pat. No. 4,155,614 a screw thread fastener means may be employed to connect the conductor and the metal clip while they are held in position in the cavity of the cap for connection together by the screw fastener means. However, besides requiring additional cost additive components such as the fastener screw means, and also a bracket-type fastening nut which must be preliminarily inserted and secured in place in the cavity of the resilient cap, the prior known in situ procedures for connecting the conductor wire to the metal clip in situ in the cavity of the resilient cap nevertheless have generally still been of a somewhat complicated and time consuming nature. In addition, the resulting connection of the conductor to the metal clip has been subject to a possible loosening or separation thereof such as can affect the structural integrity of the connection and/or the ability of the clip to firmly interengage and electrically interconnect with the anode button against unintended disengagement therefrom.

In the mounted position on the cathode ray tube of anode connector assemblies or so-called anode cups such as described above, the mounting legs of the metal clip secured within the resilient cap and engaged with the anode button holds the smooth lower surface of the flexible circular skirt portion of the cap in firm pressure engagement with the outer surface of the glass envelope of the tube. Immediately surrounding the outer edge of the skirt portion of the flexible cap is a grounded metal coating on the surface of the tube which is connected to negative ground. Thus, in the relative short distance between either the anode button or the metal clip of the anode cup and the metal shield coating on the tube, there is a very high voltage gradient during the operation of the television tube. As the voltage applied to the anode button increases, a voltage is reached where the path between the anode button and the metal shield along the surface of the anode cup ionizes and an electrical arc or spark results. This is known as the breakdown voltage. The maximum breakdown voltage which heretofore has been able to be reliably achieved with prior type anode cups is around 40 kilovolts.

The under surface of the flexible skirt portion of the resilient cap of prior anode cups or connector assemblies has been made as smooth as possible and is held in firm pressure engagement with the outer surface of the cathode ray tube envelope wall, the effort being made to eliminate any air pockets in the interface which can ionize and lower the breakdown voltage. It has been easy to make the under or lower surface of the circular skirt portion of the cap ultrasmooth by so configuring the surface of the mold employed in molding the cap. However, as a result of the manufacturing process, the cathode ray tube glass envelope outer surface has always had slight surface irregularities which result in tiny air pockets in the interface between the envelope outer surface and the surface of the skirt on the cap. The presence of such air pockets has limited the maximum breakdown voltage inasmuch as the air can ionize to form a track between the cap and the adjacent spaced edge of the grounded metal coating on the glass envelope.

When the breakdown voltage is exceeded, the heat generated by the resulting arc (or spark) burns or chars the surface of the anode cup and/or etches a line in the glass surface of the picture tube. This is known as tracking. Once tracking has occurred, the breakdown voltage then is substantially lowered. Replacement of the anode cup is then usually required.

For brighter pictures on a television picture tube, efforts have been continuously made to increase the anode voltage beyond the previously limiting 40 kilovolts heretofore employed. So far as known, however, the breakdown voltage of prior known anode connector assemblies or cups has been the limiting factor in the maximum anode voltage which can be reliably supplied to a television picture tube without causing a voltage breakdown or so-called arc out.

Summary of the Invention

The present invention contemplates a new and improved anode connector assembly which overcomes all of the above referred to problems and others and provides a connector assembly of simple and inexpensive construction employing only a single metal connector element and which can be easily and quickly assembled to provide a connector assembly which assures good alignment between the metal connector clip and the resilient support cap of the assembly and which affords markedly increased pull down force of the assembly against the envelope of the cathode ray tube and appreciably greater dielectric strength against voltage breakdown.

Briefly stated, in accordance with one aspect of the invention the anode connector assembly has a generally U-shaped one-piece sheet metal clip firmly supported and anchored in place within an axially extending relatively deep cavity or pocket in the head portion of the resilient cap member of the assembly. The metal clip is formed with spaced mounting legs extending outwardly from the open end of the cavity in the general direction of the axis thereof, and exposed within the confines of the flared out skirt portion of the cap for engaging with the anode button of the cathode ray tube. The anode voltage supply conductor extends through a confining lateral passageway in the head portion of the cap into the closed bottom end region of the cavity therein where the clip is pinch clamped in situ to a bared wire end of the conductor to electrically connect it thereto. The connection of the conductor to the anode button, on subsequent attachment of the connector assembly thereto, thus is achieved by means of a single metal connector element, thereby providing a simple and easily assembled inexpensive anode connector construction which avoids the tedious and time consuming assembly procedure of Prior art anode connector assemblies.

According to another aspect of the invention, the bared wire end of the anode voltage supply conductor, after insertion thereof into the cavity of the cap and positioning between the mounting legs of the clip seated therein, is then clamped between grip tab and pinch tab portions of the clip which extend angularly from a base strip portion thereof in directions thereunder between the mounting legs of the clip and in spaced overlapping relation with one another toward either the same open side or the opposite open sides of the clip between the mounting legs thereof. The clamping of the conductor wire end to the clip is accomplished by insertion into the cavity of the cap, between the mounting legs of the clip disposed therein, of a suitable press tool or plunger to engage with and bend the pinch tab portion of the clip against the conductor wire so as to clamp it against the grip tab of the clip.

According to a further aspect and preferred form of the invention, the pinch pad of the slip is comprised of an end extension of the base strip portion thereof which is bent back angularly thereunder to extend in the same general direction as the grip tab portion toward the same open side of the clip. The bight or U-bend of the pinch pad portion is provided with an elongated slot extending in the transverse medial axial plane of the clip, which slot is disposed adjacent and opposite the open inner end of the conductor receiving side passageway of the cap, when the clip is properly seated and anchored in place in the clip receiving cavity of the cap, in order to thereby permit the passage through the slot of the bared wire end of the conductor into clamping position between the pinch pad and grip tab portions of the clip. This preferred form of the invention affords somewhat greater leverage on the pinch pad for clamping the bared conductor wire end tightly against the grip tab.

According to still another aspect of the invention, the grip tab of the clip extends at an angle across the axis of and in a direction away from the conductor receiving side passageway leading into the cavity of the cap, so that the free end edge of the grip tab bites into the bared conductor wire, on clamping thereof between the pinch tab and grip tab portions of the clip, to thereby effectively prevent the disengagement of the conductor wire from the metal clip by any jerking or pulling forces applied to the conductor wire in an attempt to dislodge or separate the conductor assembly from the anode button of the cathode ray tube.

According to a further aspect of the invention, the clip is provided with retaining means for engaging with the pinch pad portion of the clip, on bending thereof to clamp the conductor wire between the pinch pad portion and grip tab of the clip, to thereby retain the pinch pad portion in its wire clamping position and thus maintain the electrical connection of the clip to the bared wire end of the conductor. The retaining means for this purpose preferably comprises spring locking tang means on at least one of the mounting legs of the clip and adapted to engage with and snap-lock behind or under the pinch pad portion of the clip, during the bending thereof to its wire clamping position, to thereby lock the pinch pad portion in such position. The locking tang means are preferably pressed from the mounting legs to extend at a slight inward angle relative thereto and toward the base strip portion of the clip.

According to a still further aspect of the invention, the grip tab and pinch pad portions of the clip preferably extend across practically the entire spatial distance between the spaced legs of the clip so as to not only assure that the bared wire end of the conductor will be located in proper interposed position between the pinch pad and grip tab portions of the clip for clamping therebetween, on passage of the conductor through the conductor receiving side passageway of the cap to insert its bared wire end into the cavity in the cap and between the mounting legs of the clip anchored therein, but to also assure the clamping engagement of the pinch pad portion of the clip with the spring locking tangs on the mounting legs of the clip, and ensuing snap-locking engagement of the locking tangs behind or under the pinch pad on bending thereof toward the base strip portion of the clip to its wire clamping position.

According to yet another aspect of the invention, the portion of the metal connector clip extending within the cavity of the cap is provided with laterally outwardly projecting mounting ear portions that snugly fit in recesses in and deform portions of the side walls of the cavity to lock the clip securely in place therein against movement outwardly therefrom and also aid in maintaining axial alignment of the clip relative to the cap. The mounting ears are preferably constituted by doubled-back end loop extensions of the base strip portion of the clip that joins the mounting legs thereto.

According to still another aspect of the invention, the mounting legs of the clip include inner leg portions extending in spaced, parallel flatwise opposed relation to one another and generally perpendicularly to the base strip portion on opposite sides and preferably equally distant from the transverse medial plane thereof, and they fit snugly within the cavity in the cap and extend outwardly of the open outer end thereof. The mounting legs further include intermediate leg portions extending outwardly and offset laterally outwardly from the inner leg portions, and outer leg portions extending outwardly from the intermediate leg portions in generally parallel relation both to one another and to the inner leg portions and provided at their outer ends with laterally outwardly protruding tab means to engage with the anode button of the cathode ray tube.

According to yet another aspect of the invention, the circular skirt portion of the flexible cap in which the metal connector clip is supported is made of materially smaller outside diameter as compared to that theretofore customarily employed in corresponding type anode connector assemblies whereby materially tighter pull-down of the cap against the cathode ray tube envelope and correspondingly markedly increased dielectric strength of the anode connector assembly against voltage breakdown and arc-out with resulting objectional tracking is obtained.

A principal object of the present invention is to provide an anode connector assembly of the general type referred to hereinabove which is of inexpensive and easily and quickly assembled construction and the electrical connector clip means of which is connected in situ to the anode supply conductor.

Another object of the present invention is to provide an anode connector assembly employing only a single metal connector clip element supported in place in the resilient cap member of the assembly and electrically connected in situ to the anode supply conductor.

Still another object of the present invention is to provide an anode connector assembly of the general type referred to hereinabove which enables assembly of the component parts more expeditiously than heretofore possible and without subjecting the joint between the anode supply conductor and the metal connector clip means to undesirable stresses during the assembly operation.

A further object of the present invention is to provide an anode connector assembly having improved structural integrity and strength with respect to the joint between the connector clip and the bared end of the anode voltage supply conductor to optimize maintaining electrical continuity through the joint and restraining separation or displacement of the conductor from the connector clip.

A still further object of the invention is to provide an anode connector assembly of the general type referred to hereinabove which affords and maintains improved and sturdier alignment between the metal connector clip and the resilient cap.

Yet another object of the present invention is to provide an anode connector assembly of the general type referred to hereinabove having increased dielectric strength against voltage breakdown and arc-out and increased protection against tracking failure.

Still another object of the present invention is to provide an anode connector assembly having substantially tighter pull-down of the resilient cap against the envelope of the cathode ray tube.

Further objects and advantages of the invention will appear from the following detailed description of a preferred species thereof and from the accompanying drawings.

Description of the Preferred Embodiments

Figure 1:
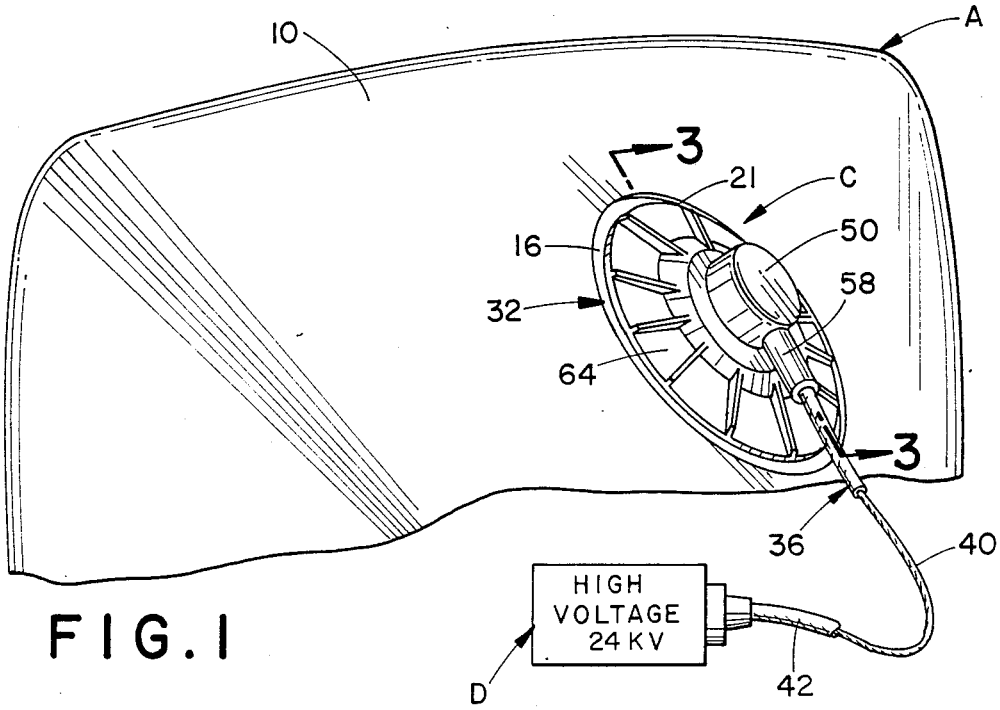
FIG. 1 is a partial perspective view of a cathode ray tube showing the connector assembly of the present invention associated therewith.
Figure 3:
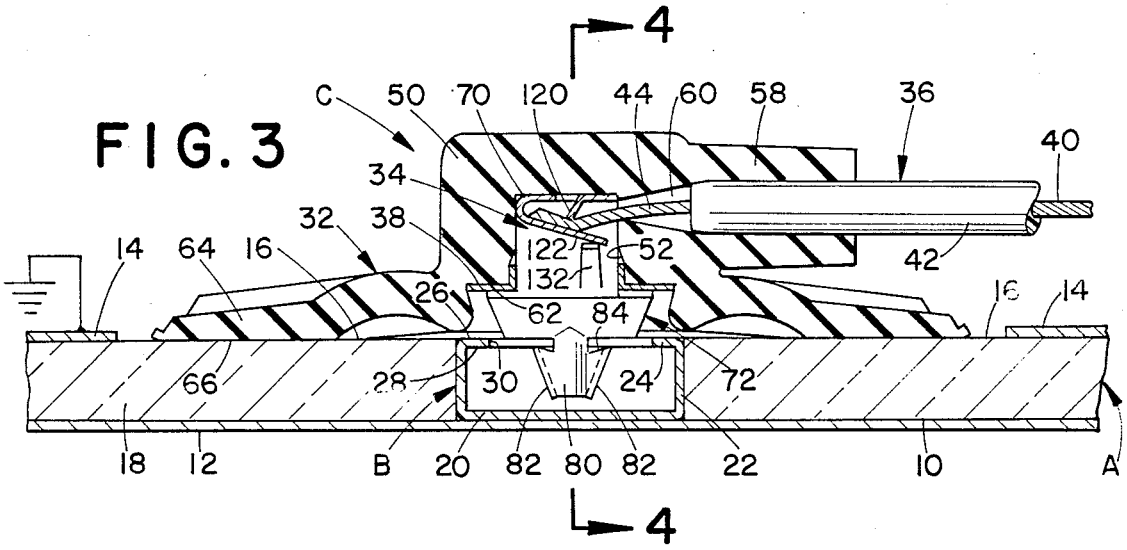
FIG. 3 is a cross-sectional view on an enlarged scale taken along the line 3—3 of FIG. 1.
Figure 4:
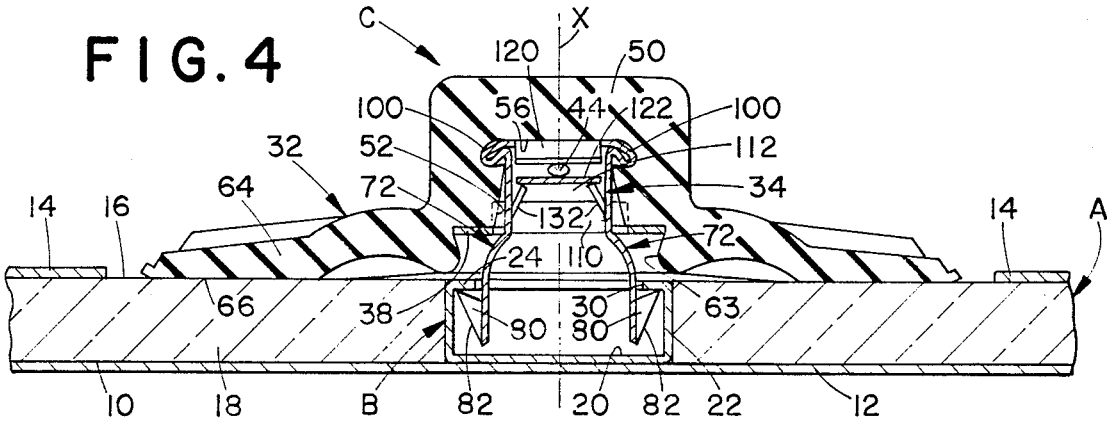
FIG. 4 is a cross-sectional view on an enlarged scale taken along the line 4—4 of FIG. 3.

Referring now to the drawings wherein the showings are for the purpose of illustrating preferred embodiments of the invention and not for the purpose of limiting the same, FIGS. 1, 3 and 4 illustrate a cathode ray tube A having a standard anode button B embedded in its side, and an anode connector assembly C according to the invention mounted on the exterior of the cathode ray tube over the anode button B for connecting the button to a high voltage supply source D. Cathode ray tube A is conventional and is comprised of a thick glass wall envelope 10 provided with a metal inner layer 12 which may be conductive or shielding, and a grounded metal outer layer 14 which is discontinuous in the area of and surrounding the connector assembly C to provide a surface 16 of bare glass therearound.

Anode button B is also conventional and is sealed in embedded relation within the wall 18 of the glass envelope 10. The anode button B is approximately the thickness of the envelope wall 18 and comprises a bottom or inner wall 20, cylindrical side wall 22, and a radially inwardly extending annular top or outer flange 24. The flange 24 includes an outer or top surface 26 coplanar with outer surface 16 of envelope 10, an underside surface 28 parallel to the outer surface 26, and a circular inner edge 30 defining a circular opening into the cup-like interior of the standard anode button B.

Figure 2:
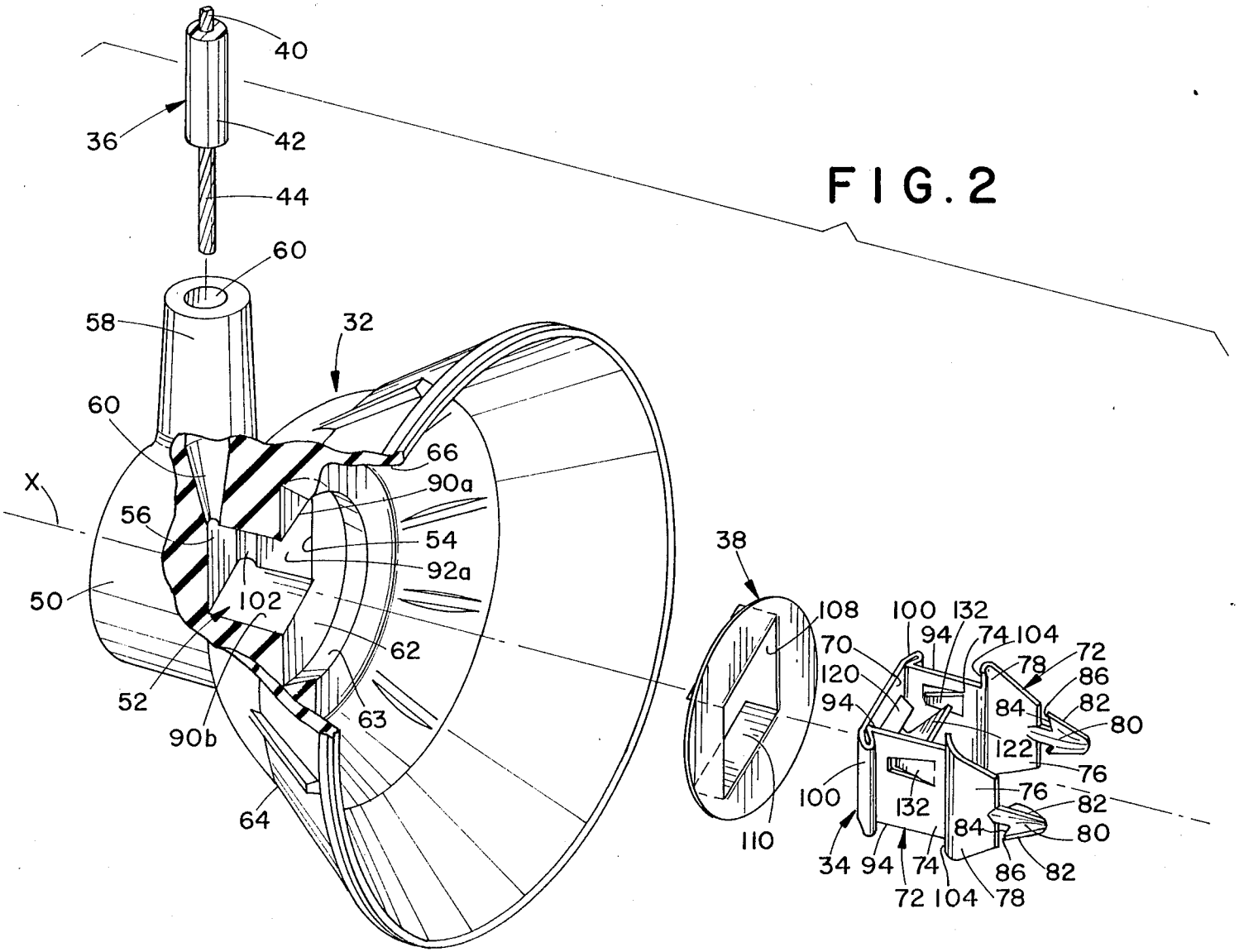
FIG. 2 is an exploded perspective view of the component parts of the connector assembly comprising the invention with the resilient cap member thereof shown partially broken away in section.

The anode connector assembly C which conducts the anode current from high voltage supply source D to the anode button B, is comprised mainly of a flexible shielding cap member or so-called anode cup 32, a metal connector clip member 34 supported in the cap, and an anode voltage supply conductor 36 extending into the cap and electrically connected to the connector clip 34 supported therewithin. The connector assembly C preferably also includes an X-ray shielding member 38 mounted within the cap around the clip member 34 therein. The conductor 36 carries the anode current from the high voltage supply source D to the connector clip 34 of the anode connector assembly, the clip being inserted in and electrically connected to the anode button B as shown in FIGS. 2 and 3. The output of the high voltage supply source D, which is schematically shown in FIG. 1 and which generally has been in the range of 25 kilovolts to an upper limit of approximately 38 to 45 kilovolts in the case of conventional prior art anode connector assemblies, may be in the range of 25 kilovolts to an upper limit as high as 46 to 55 kilovolts where the anode connector assembly C according to the present invention is employed to carry the anode current from the high voltage power supply source D to the anode button B. The anode voltage supply conductor 36 of anode connector assembly C comprises a flexible metal conductor core wire 40 encased in a sheath 42 of flexible insulation material. As will become apparent hereinafter, the end of conductor 36 opposite the end connected to the high voltage supply source D has a portion of the insulating sheath 42 removed or stripped therefrom to provide a bared wire end 44 which is electrically connected to the connector clip 34 of the anode connector assembly C.

The flexible cap or anode cup member 32 is made from a rubber-like flexible material which may be any natural rubber or irradiated polymer such as a synthetic elastomer which will provide the necessary effective resiliency, and preferably is made from silicone rubber material. Flexible cap 32 has a centrally located generally circular head portion 50 (FIG. 2) having a center axis X and provided with an axially extending cavity or pocket 52 within which the connector clip 34 is received and anchored in place. Cavity 52 has an open outer end 54 (FIG. 6) and a closed inner end formed by flat surface 56 disposed in a plane normal to the axis X of the cavity. Flexible cap 32 further includes a barrel portion 58 extending radially and laterally outward from the head portion 50 and having a conductor passageway 60 extending axially therethrough and opening at its inner end into the cavity 52 within the head portion 50. Conductor passageway 60 is normally of a diameter slightly smaller than the outside diameter of the anode voltage supply conductor 36 so that when the conductor is positioned in the passageway 60, the material defining the passageway is under tension and tightly grips the outside of the insulating sheave 42 so as to firmly hold the conductor in place in the barrel portion 58 of cap 32. Conductor passageway 60 is preferably of generally outwardly tapering form outwardly from cavity 52 to facilitate insertion of the conductor 36 and its bared wire end 44 thereinto from the open outer end of the passageway. The head portion 50 of cap 32 is further provided with a generally flat annular shoulder surface 62 bordering the open outer end 54 of the cavity 52 and forming the bottom wall of a circular recess formed in the inner end of the head portion 50 and defined by an undercut circular side wall 63 centered on the cap axis X.

Flexible cap 32 further includes a circular skirt portion 64 protruding laterally outwardly from the head portion 50 in a direction axially of the cap axis X and forwardly of the open end 54 of the cavity 52. Skirt portion 64 may be generally structured as described with respect to the flexible cap member disclosed in U.S. Letters Pat. No. 4,204,741 referred to hereinabove, and reference may be had to the latter for details concerning such structure of the skirt portion. In the connector assembly C according to the present invention, however, the circular skirt portion 64 of the flexible cap member 32 is made of appreciably smaller outside diameter than that heretofore commonly employed on the flexible cap members of prior similar type connector assemblies. The outer seating rim surface 66 of the circular skirt portion 64 of flexible cap 32 is formed, in accordance with the present invention, with an outside diameter of around two inches or so, as compared to the two and one-half inches outside diameter conventionally employed heretofore for such seating rim surfaces. Due to the reduced diameter and resulting reduced flexibility or stiffer character of the skirt portion 64, the anode connector assembly C according to the invention therefore affords a markedly increased, e.g. around a 25% or so tighter hold down grip of the flexible cap 32 and connector assembly C against the outer surface 16 of the glass envelope 10 of the cathode ray tube A, when the assembly C is installed in place thereon with the skirt portion 64 of the cap 32 forcibly pressed and flexed against the envelope 10 and the connector clip member 34 engaged with and electrically connected to the anode button B. Because of their tighter hold down grip against the cathode ray tube envelope 10, connector assemblies C according to the invention therefore possess substantially increased, e.g. around 25% or so greater dielectric strength against high voltage breakdown and arc-out of the connector assembly and the resistance thereof to tracking. Thus, whereas the breakdown voltage of prior anode connector assemblies employing two and one-half inch diameter flexible caps 32 has ranged from around 38 to 45 kilovolts, the breakdown voltage of connector assemblies C according to the invention desirably has been within the considerably higher range of around 46 to 55 kilovolts.

The metal connector clip means 34 of the connector assembly C comprises a one-piece generally U-shaped member formed of tin plated spring steel sheet or strip material of a thickness around 0.012 to 0.014 inches, for example, and including a flat base strip portion 70 and a pair of mounting legs 72 integral therewith and extending in spaced side-by-side flatwise opposed relation on opposite sides of and preferably equidistant from the transverse medial plane P (FIG. 6) of the base strip portion. The mounting legs 72 are adapted to engage with the anode button B to mount the connector assembly C in place on the exterior of the cathode ray tube envelope 10 with the anode voltage supply conductor 36 of the assembly C electrically connected by the connector clip member 34 to the anode button B.

The mounting legs 72 of clip member 34 include inner leg portions 74 integral with the base strip portion 70 and extending in flatwise opposed spaced parallel relation to one another and perpendicularly to the base strip portion. Clip member 34 further includes flatwise opposed outer leg portions 76 extending parallel to one another and to the inner leg portions 74 and each laterally outwardly offset equidistantly from the corresponding inner leg portions 74 and from the medial plane P of the clip. The outer leg portions 76 are integrally interconnected with the inner leg portions 74 by corresponding intermediate leg portions 78 of the clip which also are offset laterally outwardly from the inner leg portions 74. The outermost ends of outer leg portions 76 are structured to interengage and electrically connect with anode button B and, for this purpose, preferably are structured as disclosed in U.S. Pat. No. 4,204,741 referred to hereinabove. Mainly to this end, the outermost ends of the outer leg portions 76 are formed with laterally outwardly protruding hooks or locking tab means 80 of generally U-shaped transverse cross-section and each having endwise and inwardly converging side edges 82 for camming engagement with the circular rim of the opening 30 in the anode button B to aid in the insertion of the clip 34 into the cup-like interior thereof. The tab means 80 also have laterally extending hook forming edges 84 which face toward the base strip end 70 of the clip 34 and converge with the side edges 82 of the tab means 80 to form pointed tab corners 86. When the outermost ends of the clip legs 72 are passed through and compressed together by the center opening 30 in the anode button B and then released, during the mounting of the connector assembly C in place on the cathode ray tube envelope 10, the tab corners 86 of the locking tab means 80 then engage and snap-lock behind the underside of the flange 24 on the anode button to thereby lock the assembly C in place on the envelope 10 with the circular skirt portion 64 of the cap member 32 flexed to seat the outer rim 66 thereof tightly against the bare glass outer surface 16 of the envelope and draw and hold the tabs 84 in tight electrically connected engagement with the flange 24 of the anode button B.

The connector clip member 34 is supported and anchored in place within the cavity 52 in head portion 50 of the flexible cap member 32 so as to be firmly held in axial alignment with the cap member. To this end, the clip member 34 is supported in the cavity 52 with its flat base strip portion 70 abutting and seated flatwise against the closed flat inner end 56 of the cavity and with its inner leg portions 74 fitting snugly within the cavity across their width dimension and extending outwardly from the open outer end 54 of the cavity. The cavity 52 as molded, is of box-shaped form having a rectangular cross-sectional shape throughout its axial extent which generally matches the rectangular outside cross-sectional contour or conjoint outline of the parallel extending inner leg portions 74 of the clip member 34. In addition to its closed inner end wall 56, the cavity is formed by four side walls, namely opposed pairs of side walls **90*a*, 90*b* and 92*a*, 92*b*, arranged in a square-like format centered about the cap axis X. Cavity side walls 90*a*, 90*b*, as molded, extend parallel to one another and are spaced apart a distance corresponding to the width dimension $d_1$ (FIG. 5) between the side edges 94 of each of the inner leg portions 74 of the clip 34 so that the inner leg portions snugly fit between and engage the side walls 90*a*, 90*b* when the clip 34 is properly fitted in place in the cavity 52, thereby firmly holding the clip in axial alignment with the cap against any rocking movement therein in an axial plane of the cap parallel to the planes of the flat inner leg portions 74**.

The connector clip member 34 is formed at opposite ends of its base strip portions 70 with laterally outwardly projecting mounting ear portions 100 which are press fitted into groove-like semi-cylindrical recesses or pockets 102 formed in, and extending across the width of the opposed side walls **92*a*, 92*b* of the cavity 52, immediately alongside or adjacent the closed inner end wall 56 thereof, to thereby lock the clip member 34 in place within the cavity 52 against unintended movement outwardly thereof. The mounting ears 100 are preferably formed, as shown, by doubled-back end loop extensions of the base strip portion 70 of the connector clip member 34, the end loop extensions joining the inner leg portions 74 of the clip member to the base strip portion 70. Also, the end loop extensions or mounting ears 100 preferably are angularly bent downwardly alongside the adjacent mounting legs 72 of the clip member, as shown, in order to impart increased resistance to upward bending thereof and minimize the likelihood of the clip member 34 becoming loosened in the cavity 52 and consequently misaligned in the cap 32**.

The mounting ears 100 of the clip member 34 are dimensioned so that their overall reach or distance between their outermost ends is slightly greater, e.g., around 0.020 to 0.030 inch or so greater than the span or full distance, transversely of the cap axis X, between the deepest ends of the grooved recesses or pockets 102 in the cavity 52 within which the mounting ears 100 are received. Likewise, the dimensional extent or height of the mounting ears 100 axially of the clip member 34 is made slightly greater, e.g., around 0.010 inch or so greater than the corresponding maximum height dimension of the grooved recesses or pockets 102 axially of the cap member, i.e., longitudinally of the cap axis X.

Figure 6:
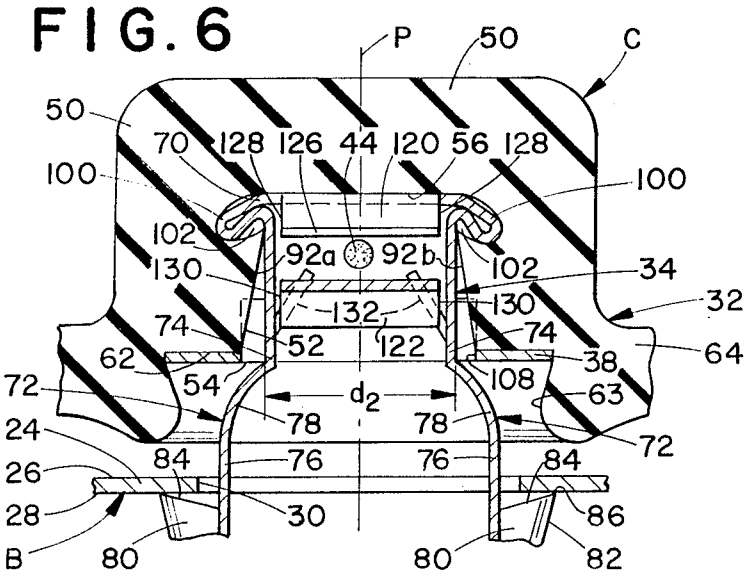
FIG. 6 is a partial cross-sectional view taken on the line 6—6 of FIG. 5.
Figure 8:
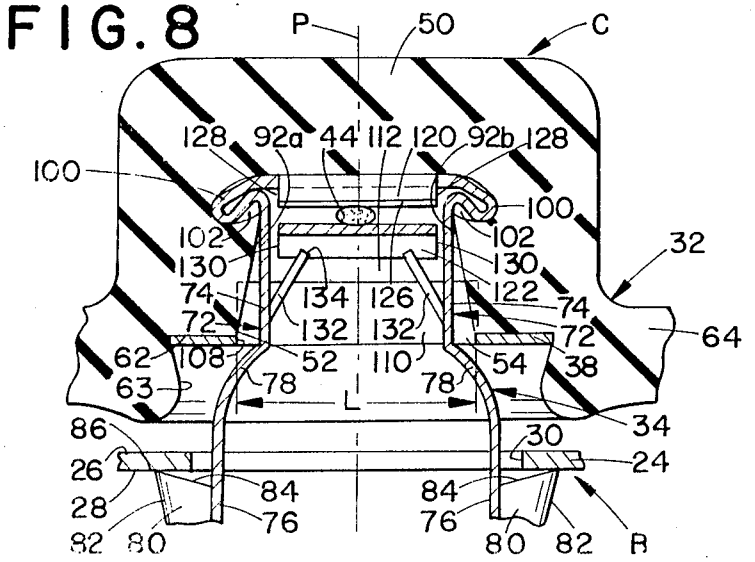
Figure 9:
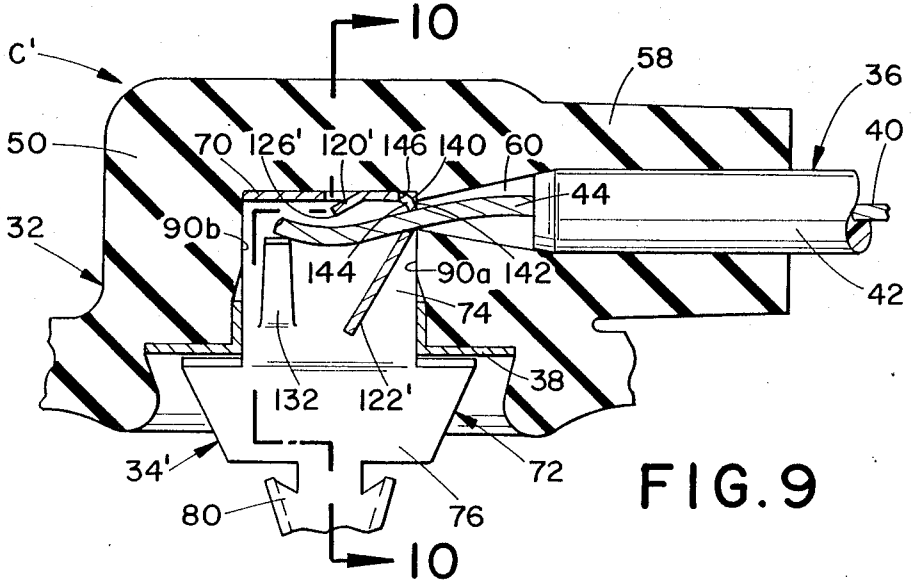
FIG. 9 is a partial cross-sectional view on an enlarged scale similar to FIG. 5 and showing a modified and preferred embodiment of the connector assembly according to the invention.

The fitting of the mounting ears 100 into the somewhat smaller size or shallower grooved recesses 102 in side walls 92*a*, 92*b* of the cavity 52 in the cap 32, during the insertion and mounting of the clip member 34 in the cavity, is accomplished by flexing the head portion 50 of the cap member to spread apart the walls 92*a*, 92*b* of the cavity so as to widen it and further open or enlarge the grooved recesses 102 sufficiently to permit the insertion and passage of the mounting ears 100 thereinto. The flexible character of the cap member 32 and its head portion 50 readily permits the necessary flexing of the head portion to enable such insertion of the larger mounting ears 100 into the recesses 102. To also facilitate this insertion of the mounting ears 100, the opposing side walls 92*a*, 92*b* of the cavity 52 are slightly flared out toward the open end 54 thereof, as shown in FIGS. 6 and 8. On subsequent removal of the flexuring force from the cap 32 and its head portion 50, the walls of the grooved recesses 102 then return toward their normal unflexed state but remain in a deform®d condition to forcibly press against the mounting ears 100 of the clip member 34, both laterally and longitudinally inwardly of the cavity 52, to thereby support and firmly hold the clip member in place in the cavity 52 in axial alignment with the cap against any rocking movement therein in that axial plane of the cap which is normal to the planes of the flat inner leg portions 74 of the clip member. The pressure engagement of the walls of the deformed grooved recess 102 with the mounting ears 100 of the clip member 34 also acts to urge the clip 34 axially inwardly of the cavity 52 so as to press and hold the flat base strip portion 70 of the clip inwardly of the cavity 52 and flatwise against and in firm engagement with the flat, closed inner end 56 of the cavity. This then acts to further aid in the supporting and holding of the clip 34 firmly in the cavity 52 in axial alignment with the cap member 32.

Figure 5:
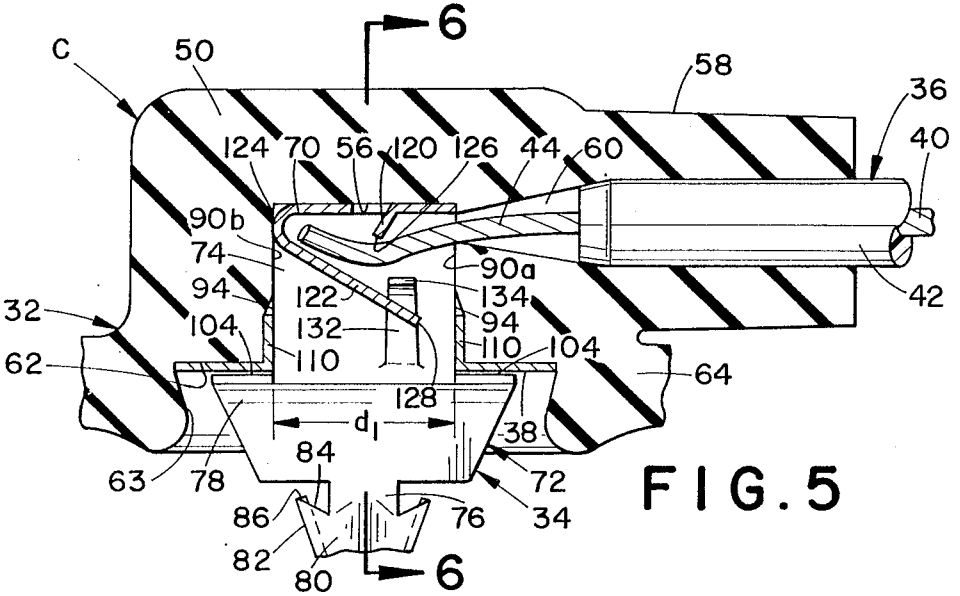
FIG. 5 is a partial cross-sectional view similar to FIG. 3 on an enlarged scale but showing the connector clip and conductor positioned in place within the cap in readiness for the clamping together thereof.
Figure 7:
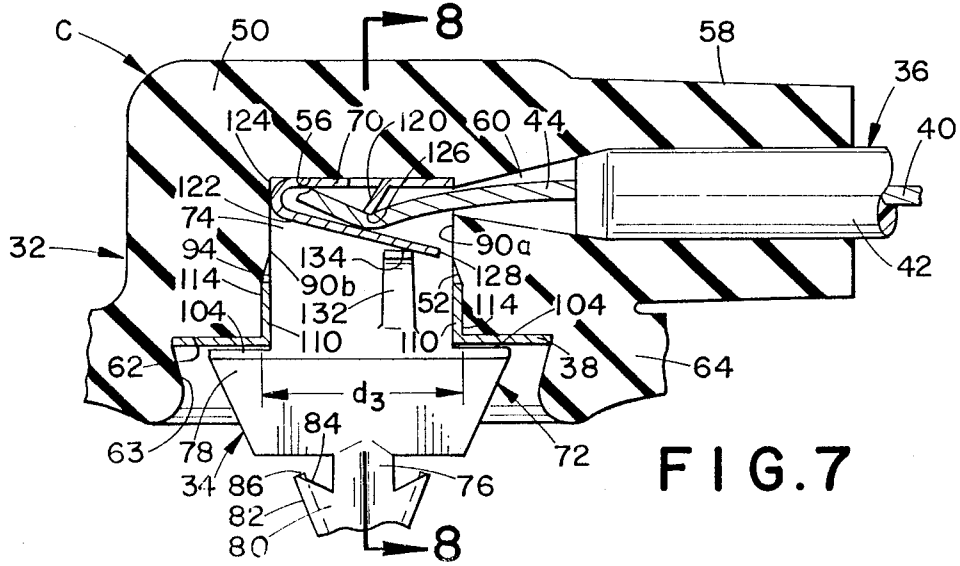
FIG. 7 is a partial cross-sectional view similar to FIG. 3 on an enlarged scale showing the completed clamp connection between the connector clip and the bared wire end of the conductor; and, FIG. 8 is a partial cross-sectional view taken on the line 8—8 of FIG. 7.

As best shown in FIGS. 5 and 7, the intermediate leg portions 78 of the mounting legs 72 on clip member 34 are formed of wider dimension at their juncture with the inner leg portions 74 to provide laterally outwardly extending and aligned abutment shoulders 104 facing toward the inner leg portions 74 and base strip portion 70 of the clip. The X-ray shielding member 38 which is mounted on the clip member 34 comprises a metallic shielding disc or washer interposed between these lateral abutment shoulders 104 and the annular shoulder 62 bordering the outer end 54 of cavity 52 in the head portion 50 of cap member 32. The abutment shoulders 104 prevent unwanted dislodgement of the shielding member 38 from its seated position within the cavity 52. The shielding member or disc 38 is circumferentially uninterrupted and is snugly fitted within the undercut circular recess 63 in the inner end of the head portion 50 of cap member 32 and bordering the open end of the cavity 53 therein to aid in centering the disc 38 on the axis X of the cap member 32. B®cause of the flexible character of the cap member 32 and its skirt portion 64, the circular recess 63 in the head portion 50 of the cap member 32 may be spread open to the larger diameter necessary to enable insertion and passage thereinto of the slightly larger diameter shielding disc 38.

The shielding disc 38 is provided with a central opening 108 therethrough which is configured to correspond to the rectangular outside cross-sectional contour outline around the two inner leg portions 74 of the connector clip 34 and which is adapted to receive these leg portions 74. The opening 108 may be provided by punching the metal disc 38 so as to leave a pair of flanges 110 along opposite sides of the opening 108 which are bent outwardly to extend normal to the plane of the disc 38 and, in its installed position in the cap 32, project into the cavity 52 adjacent and in snug fitting relation with the opposite side edges 94 of the inner leg portions 74 of the clip member 34 positioned in the cavity 52. When the cap member 32, connector clip member 34 and shielding disc member 38 of the connector assembly are in their assembled relationship, the shielding disc 38 is seated and pressed firmly against the flat annular shoulder 62 of cap member 32 with the opposed flanges 110 of the shielding disc spanning the space between the inner leg portions 74 of the clip member, from intermediate portions 78 thereof toward the base strip portion 70. Thus, only a small space 112 (FIGS. 4 and 8) between base strip portion 70 and the inner end of each flange 110 of the shielding member 38 is left open to X-ray emission to the outside of the cathode ray tube A.

As evident from FIG. 8, the length L of the upstanding flanges 110 along the edges of the central opening 108 in the shielding member 38 is made slightly greater than the dimension across the open end 54 of cavity 52 between the side walls 92*a*, 92*b* thereof. Accordingly, during the assembly of the clip member 34 and shielding disc member 38 with the cap member 32, the yieldable cavity side walls 92*a*, 92*b* necessarily must be spread apart the required slight amount, at the regions thereof adjacent the open outer end 54 of the cavity 52, to permit the insertion of the flanges 110 between the cavity side walls 92*a*, 92*b*. The deformed portions of the side walls 92*a*, 92*b* of the cavity 52 thus yieldably grip the opposite end edges of the flanges 110 on the shielding disc member 38 to aid in firmly holding it in proper aligned position in the cavity 52. Also, as evident from FIG. 7, because the flanges 110 on shielding disc member 38 extend across and lie outside the side edges 94 of the inner leg portions 74 of the clip member 34 in the completed connector assembly C, the distance $d_3$ between the outer side faces 114 of these flanges 110 therefore necessarily exceeds the width $d_1$ of the inner leg portions 74 and the corresponding width of the cavity 52 between the side walls 90*a*, 90*b* thereof between which walls the flanges 110 are inserted. Thus, the yieldable cavity side walls 90*a*, 90*b* also must be necessarily spread apart the required slight extent, at the regions thereof adjacent the open outer end of the cavity 52 and lying in the plane of the flanges 110, to permit the insertion of these flanges therebetween during the assembly of the clip member 34 and shielding disc member 38 with the cap member 32. The resultantly deformed regions of the side walls 90*a*, 90*b* of the cavity 52 therefore also yieldably grip the outer side faces 114 of the flanges 110 on the shielding disc member 38 to aid in firmly holding it in proper aligned position in the cavity 52.

It will be appreciated that the extended bearing afforded by the cavity side walls 90*a*, 90*b* and flanges 110 of the fixedly held shielding disc 38 against and along the length of the snugly fitting side edges 94 of the inner leg portions 74 of clip member 34, and also the pressure bearing engagement afforded by the mounting ears 100 of the flat base strip portion 70 of the clip member against the flat inner end 56 of the cavity, together combine to support and hold the connector clip member 34 firmly in position in the cavity 52 of the cap member 32 and maintain optimum axial alignment of the clip member with the cap member.

In accordance with a principal aspect of the invention, the electrical connection of the anode voltage supply conductor 36 to the metal connector clip member 34 is accomplished within the cavity 52 of the cap member 32 by directly mechanically connecting the cavity inserted clip member in situ to the bared end 44 of the conductor. For this purpose, the clip member 34 is provided with clamp means comprising a grip tab portion 120 and a pinch pad portion 122 between which the bared wire end 44 of the conductor 36 is pinched while the clip member is in its seated and locked position in the cavity 52 of the cap member 32, to thereby electrically connect the clip member to the conductor. The grip tab portion 120 is pressed out and bent inwardly from the base strip portion 70 of the clip member to extend at an acute angle relative thereto between the inner leg portions 74 of the clip member and toward one of the side edges of the base strip portion, e.g., side edge 124 (FIGS. 5 and 7) in the form of the invention shown in FIGS. 2-8, and with its free end edge 126 extending longitudinally of the base strip portion 70. The pinch pad portion 122 of the clip member 24 extends from this side edge 124 of the base strip portion 70 and is bent back thereunder to extend transversely inwardly of the clip member between the inner leg portions 74 thereof and in a direction opposite to the direction in which the grip tab portion extends from the base strip portion 70. In its as formed state prior to the clamping of the conductor wire 44 to the clip member 34, the pinch pad portion 122 extends at an acute angle to the base strip portion and toward and overlapping but in sufficiently spaced relation to the free end edge 126 of the grip tab portion 120 to permit the insertion of the bared wire end 44 of the conductor 36, on insertion through passageway 60 and into the cavity 52, into a position between the grip tab and pinch pad portions 120, 122, as shown in FIGS. 5 and 6.

The connector clip member 34 is installed in place in the cavity 52 of cap member 32 with the free end edge 128 of its pinch pad portion 122, and thus the mouth opening of the space between the pinch pad portion and the base strip portion 70 of the cap member, facing toward that one of the cavity side walls, i.e. side wall 90*a* in the case illustrated, through which the conductor passageway 60 in the head portion 50 of the cap member opens into the cavity 52 at a location immediately adjoining the closed inner end wall 56 thereof. The clip member 34 thus is in its proper seated position in the cavity 52 of the cap member 32 to receive the bared wire end 44 of the conductor 36 between its inner leg portions 74 and between its grip tab and pinch pad portions 120 and 122, on insertion of the conductor, bared wire end first, into and passage through the passageway 60.

To assure that the bared wire end 44 of the conductor 52 will be located in proper position for clamping between the free end edge 126 of the grip tab portion 120 and the pinch pad portion 122, on insertion of the wire end through the passageway 60 in the cap member 32 into the cavity 52 and between the inner leg portions 74 of the clip member 34 therein, and not be mispositioned instead to one side or the other of either the grip tab or pinch tab portions 120, 122 so as to be then located out of proper clamping position therebetween, the grip tab and pinch tab portions 120, 122 are made of a width to each extend across substantially the entire spacial distance between the parallel inner leg portions 74 of the clip member 34, as shown in FIGS. 6 and 8. The bared wire end 44 of the conductor 36 is thereby prevented from slipping alongside one or the other of the side edges 128 or 130 of either the grip tab portion 120 or pinch pad portion 122, respectively, of the clip member, on the insertion of the bared wire end 44 into the clip member between the inner leg portions 74 thereof, so as to be then located out of proper clamping position between the grip tab and pinch pad portions. Also, the pinch pad portion 122 of the clip member 34, as formed, is bent back at an angle from the base strip portion 70 such as to locate its free end edge 128 at a region within the cavity 52 located outwardly thereof beyond the opening of the passageway 60 into the cavity, in the seated position of the clip member therein, so as not to obstruct or prevent in any way, and instead positively assure the free passage of the bared wire end 44 into the mouth of the opening between the base strip and pinch pad portions 70 and 122 of the clip member 34 when the bared wire end 44 is pushed through the passageway 60 and into the cavity 52.

With the bared wire end 44 of the conductor 36 thus inserted into the cavity 52 and held in proper clamping position as shown in FIGS. 5 and 6, between the grip tab and pinch pad portions 120 and 122 of the clip member 34, the pinch pad portion 122 is then bent further inwardly of the clip member 34 toward the grip tab portion 120 thereof by a suitable pinching tool or plunger (not shown) inserted into the cavity through its open outer end 54, to thereby pinch and tightly clamp the bared wire end 44 between the grip tab and pinch pad portions 120, 122, as shown in FIGS. 7 and 8, and so electrically connect the clip member 34 to the anode voltage supply conductor 36. During the pinching operation, the sharp free end edge 126 of the grip tab portion 120 bites into the material of the bared wire end 44 and this, coupled with the forwardly angled extent of the grip tab portion 120 toward the free end of the bared wire end 44, then acts to positively restrain and prevent the separation of the connection between the clip member and the bared wire end as by an outward jerking or pulling of the conductor 36 by one attempting to disconnect the connector assembly C from the anode button B of a cathode ray tube A.

According to a further aspect of the invention, the clip member 34 is provided with retaining means for locking the pinch pad portion 122 in its wire clamping position as described above and shown in FIGS. 7 and 8. The retaining means may suitably comprise yieldable spring locking tang means 132 located on one or preferably both, as shown, of the parallel inner leg portions 74 of the clip member 34. The locking tangs 132 are pressed from the inner leg portions 74 of the mounting legs 72 of the clip member 34 to extend inwardly of the leg portions 74 toward the base strip portion 70 of the clip member and at a small acute angle to leg portions 74, e.g. around 30°, sufficient to insure the positive engagement of the side edges 130 of the pinch pad 122 with the tangs 132 during the bending of the pinch pad inwardly of the clip member to its wire clamping position. The side edges 130 of the pinch pad portion 122 thus engage with and deflect or cam the spring locking tangs 132 outwardly away from one another, during the inward bending of the pinch pad portion to its wire clamping position, to permit the passage of the pinch pad portion between and past the deflected spring tangs to its wire clamping position at which time the springs then spring back and return to their normal unflexed position snap-locked behind or under the pinch pad portion 122, with their free end edges 134 engaged with the underside of the pinch pad portion 122. The spring tangs 132 thus retain the pinch pad portion 122 in place in its wire clamping position and prevent any unbending thereof such as might cause undesired loosening or separation of the clamped connection of the clip member 34 to the bared wire end 44 of conductor 36. The bending of the pinch pad portion 122 of the clip member 34 to its wire clamping position, and the locking of the pinch pad portion in such position by the spring tangs 132, then completes the assembly of the anode connector assembly C comprising the invention.

The connector assembly C may be attached to the anode button B of a cathode ray tube A simply by placing the assembly in centered position directly opposite or over the anode button B and then forcibly pressing and flexing the skirt portion 64 of the flexible cap member 32 of the assembly C against the envelope 10 of the cathode ray tube to cause the hooked ends 80 on the mounting legs 72 of the clip member 34 to enter and pass through and be spring deflected inwardly by the circular edge 30 forming the central opening of the anode button, and thence snap-lock behind the annular top flange 24 of the anode button to tightly secure the assembly C in place on the cathode ray tube with the mounting legs 72 of the connector clip 34 engaged with, and thus the anode voltage supply conductor 36 of the assembly C electrically connected to the anode button B. During the insertion of the clip member 34 into the anode button, the pressing of the skirt portion 64 against the outer surface 16 of the envelope 10 causes the skirt portion to flex radially outwardly and resiliently engage the outer rim 66 thereof with the envelope surface 16 to create a seal therewith around and concentric with the anode button B and to resiliently bias the clip member 34 into tight engagement with the anode button against unintentional separation therefrom and form a positive electrical connection thereto.

FIGS. 9–14 illustrate a modified and preferred form of connector assembly C′ according to the invention which affords, among other things, a tighter clamping and more positive electrical connection of the bared wire end 44 of the anode voltage supply conductor 36 to the metal clip member 34′ of the connector assembly. Except for the form of the grip tab and pinch pad portions 120′ and 122′ of the clip member 34′, the connector assembly C′ is otherwise essentially the same as the connector assembly C shown in FIGS. 2–8.

The modified connector assembly C′ of FIGS. 9–14 differs from the connector assembly C of FIGS. 2–8 principally in that the metal clip member 34′ is installed in the cavity 52 of the cap member 32 in a 180° axially reversed oriented position from that of the clip member 34, with the bight or U-bend 140 of the pinch pad portion 122′ disposed directly opposite and contiguous the open inner end 142 of the conductor receiving passageway 60 in the cap member 32 so that the pinch pad portion 122′ extends, from the base strip portion 70 of the inserted clip member 34′, in a retroverted and acute angular direction relative thereto away from the open inner end 142 of the conductor wire passageway 60 instead of toward such open inner end 142 as in FIGS. 2–8.

To permit the introduction of the bared wire end 44 of the conductor 36 from the passageway 60 into the cavity 52 in the cap member 32 and into clamping position therein between the grip tab and pinch pad portions 120′ and 122′ of the clip member 34′ in readiness for clamping therebetween, the pinch pad portion 122′ of the clip member 34′ is provided with a slot-shaped aperture 144 located medially thereof and extending throughout the arcuate extent of the bight or U-bend portion 140 of and continuing a short distance into the flat main portion of the pinch pad portion 122′, and disposed opposite and aligned with the open inner end 142 of the conductor passageway 60 in the cap portion 32 of the connector assembly C′. The slot-shaped aperture 144 is of sufficient length and transverse width to freely receive therethrough the bared wire end 44 of the anode voltage supply conductor 36 on feeding thereof from the inner end 142 of the passageway 60 into the cavity 52 of the cap member 32 for clamping to the clip member.

As shown, the open inner end 142 of the conductor receiving passageway 60 in cap member 32 is spaced, in the same manner as in FIGS. 2–8, outwardly of the cavity 52 from the flat closed inner end 56 thereof, a slight distance at least equal to the thickness of the base strip portion 70 of the metal clip member 34′. This spacing assures that the end of the bared wire end portion 44 of the conductor 36, on feeding thereof through the open inner end of the conductor passageway 60 into the cavity 52 of the cap member 32, will not abut and catch against the end 146 of the slot-shaped aperture 144 located at or near the juncture of the bight or U-bend 140 of the pinch pad portion 122′ with the flat base strip portion 70 and so being prevented from freely passing through the slot-shaped aperture 144 into the desired position between the grip tab portion 120′ of the base strip portion 70 and the pinch pad portion 122′ of the clip member 34′, in readiness for clamping therebetween.

The grip tab portion 120′ of the modified clip member 34′ also differs from the grip tab portion 120 of the clip member 34 shown in FIGS. 2–8 in that it is pressed out and bent inwardly from the base strip portion 70 of the clip member to extend at an acute angle therefrom in the same general direction as the pinch pad portion 122′ instead of 30 in an opposite direction as in FIGS. 2–8. The pinch pad portion 122′ overlaps the free end edge 126′ of the grip tab portion 120′ of the clip member 34′ and extends therebeyond across almost the full width of the inner leg portions 74 of the clip member. The pinch pad portion 122′, however, overlaps the free end edge 126′ of the grip tap portion 120′ in sufficiently spaced relation thereto to permit the free passage of the bared wire end 44 of the conductor wire 36 therebetween and into position for clamping to the clip member 34′, on insertion of the bared wire end 44 through the passageway 60 and through the slot-shaped aperture 144 in the pinch pad portion 122′ of the clip member 34′ into the cavity 52 of the cap member 32.

Figure 11:
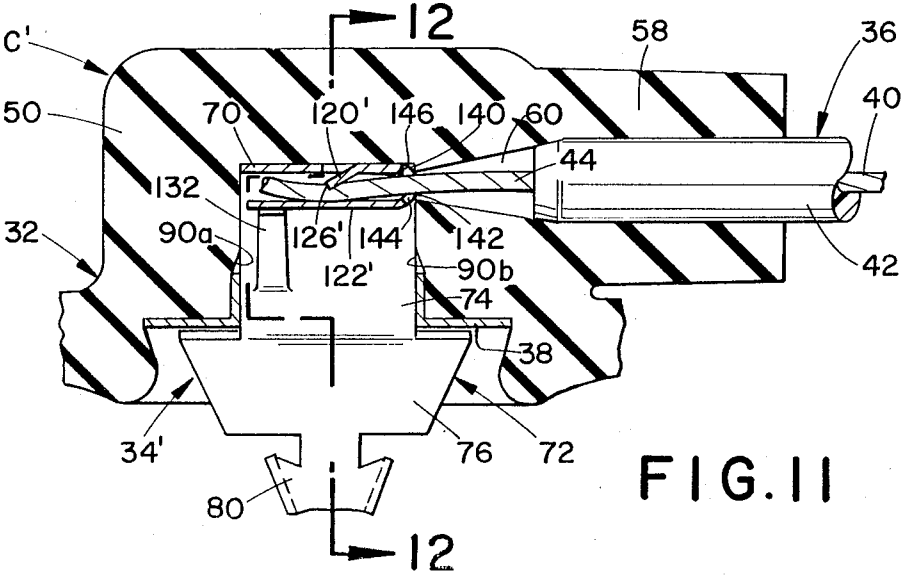
FIG. 11 is a partial cross-sectional view similar to FIG. 7 of the modified embodiment of the invention shown in FIG. 9.
Figure 10:
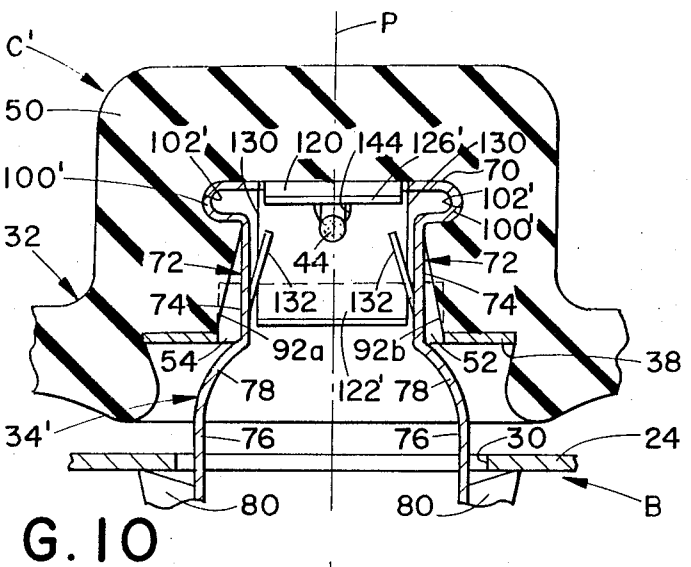
FIG. 10 is a partial cross-sectional view taken on the line 10—10 of FIG. 9.
Figure 12:
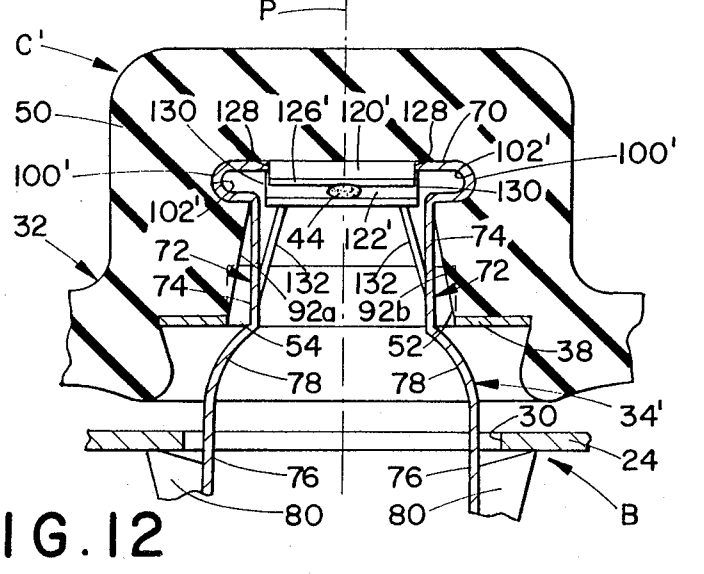
FIG. 12 is a partial cross-sectional view taken on the line 12—12 of FIG. 11.
Figure 14:
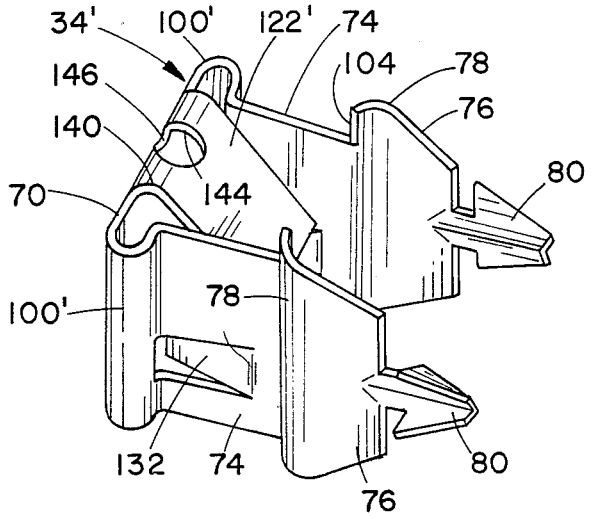

The clamping and electrical connecting of the bared wire end 44 of the conductor wire 36 to the modified clip member 34′, after the insertion thereof into clamping position between the grip tab and pinch pad portions 120′ and 122′ of the clip member, is effected in the same manner as described previously with respect to the clip member 34, i.e., by bending the pinch pad portion 122′ further inwardly of the clip member 34′ toward the grip tab portion 120′ thereof by a suitable pinching tool or plunger inserted into the cavity 52 of the cap member 32 through its open outer end 54, to thereby pinch and tightly clamp the bared wire end 44 between the pinch pad portion 122' and the free end edge 126' of the grip tab portion 120', as shown in FIGURES 11 and 12. During this pinching operation, the sharp free end edge 126' of the grip tab portion 120' digs or bites into the material of the bared wire end 44 of conductor 36 and this, coupled with the forwardly angled disposition of the grip tab portion 120' toward the free end of the inserted bared wire end 44, then acts to positively restrain and prevent the separation of the connection between the clip member and the bared wire end as by an outward jerking or pulling of the conductor 36 by one attempting to disconnect the connector assembly C' from the anode button B of a cathode ray tube.

As before, the modified clip member 34' is provided with suitable retaining means such as the yieldable spring locking tang means 132 similar to those formed on the leg portions 74 of the clip member 34 of FIGS. 2–8, for snap-locking behind or catching under the pinch pad portion 122' during the bending thereof to its conductor wire clamping position. The snapped in locking tangs 132 then maintain the pinch pad portion 122' locked in place in its wire clamping position as shown in FIGS. 11 and 12 and so prevent any unbending thereof such as would cause undesired loosening or separation of the clamped connection of the clip member 34' to the bared Wire end 44 of the conductor 36.

Figure 13:
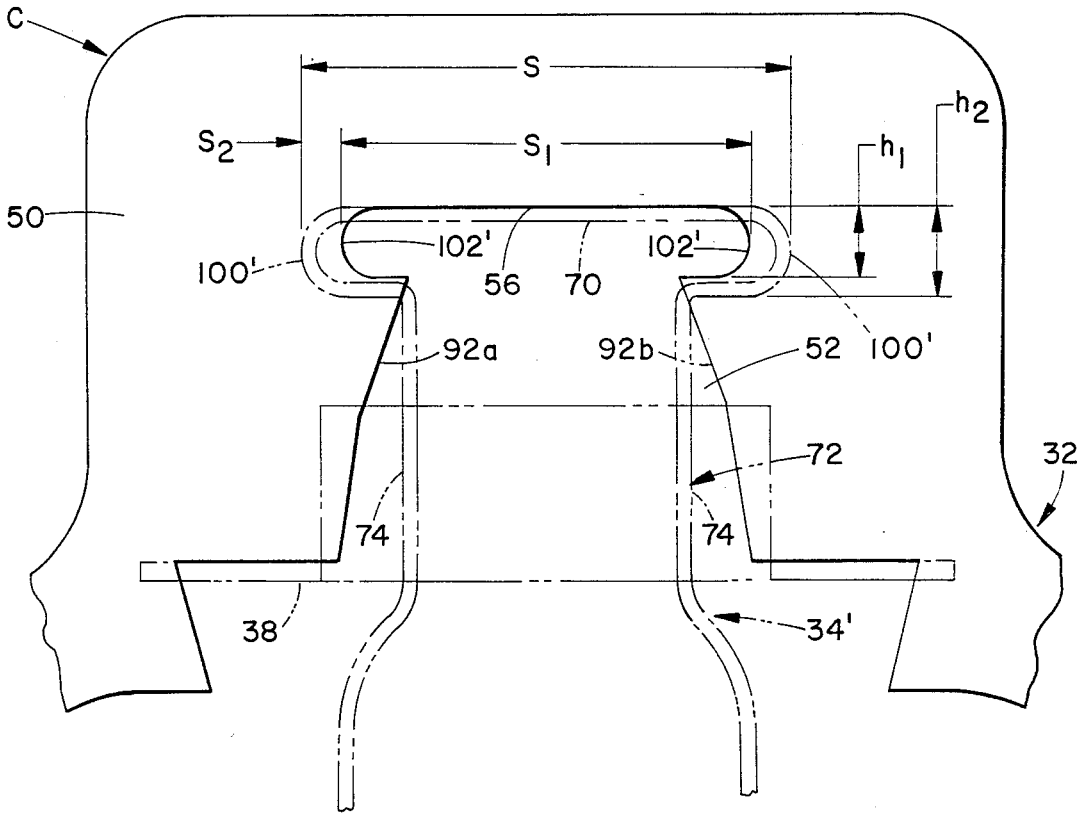
FIG. 13 is, a schematic outline view of the metal clip element of the connector assembly shown in FIGS. 9–12 superimposed in its seated position in the clip-receiving cavity of the resilient cap member of the assembly; and, FIG. 14 is a perspective view on an enlarged scale of the metal clip of the modified connector assembly embodiment of FIGS. 9–13.

Instead of being angularly bent downwardly alongside the adjacent mounting legs 72 of the clip member as in FIGS. 2–8, the doubled-back end loop extensions or mounting ears 100' of the modified clip member 34' of FIGURES 9–14 may extend, as shown, laterally straight outward from the respective mounting legs 72 of the clip so as to lie in a common plane extending transversely of the clip axis X. As in the case of the mounting ears 100 in FIGS. 2-8, the mounting ears 100' are also formed of slightly larger size than the grooved recesses or pockets 102' in the walls **92*a*, 92*b* of the cavity 52 in which recesses 102' the mounting ears 100' are press fitted to anchor them in place in the cavity 52. Thus, in the particular case as schematically illustrated in FIG. 13, the mounting ears 100' on the clip 34' are dimensioned so that their overall reach or span distance s of approximately 0.41 inches or so between their laterally outermost extremities is slightly greater, e.g. around 0.066 inches greater than the overall reach or span distance $s_1$ of approximately 0.344 inches between the deepest portions or bottoms of the grooved recesses or pockets 102' in the side walls 92*a*, 92*b* of the cavity 52 in the cap 32. The so dimensioned mounting ears 100' thus each project laterally outward from the parallel inner leg portions 72 of the clip 34'** a distance $s_2$ *of around* 0.033inches greater than the deepest portions or bottoms of the grooved recesses 102' into which the mounting ears 100' are designed to be fitted in the assembly of the clip 34' into the cap member 32. The mounting ears 100' are also dimensioned so that their height $h_2$ axially of the clip 34' of approximately 0.075 inches is slightly greater, e.g. around 0.015 inches greater than the height $h_1$ of approximately 0.060 inches of the grooved recesses 102' axially of the cap member 32, i.e. longitudinally of the cap axis X.

The fitting of the mounting ears 102' of the modified clip 34' of FIGS. 9–14 into the smaller size and shallower grooved recesses 102' in the side walls **92*a*, 92*b* of the cavity 52, during the insertion and mounting of the clip in the cavity, is accomplished in the same manner as described above in connection with the clip 34 of FIGS. 2–8, i.e. by flexing the head portion 50 of the cap member 32 to spread apart the walls 92*a*, 92*b* of the cavity so as to widen it and further open or enlarge the grooved recesses 102' sufficiently to receive the mounting ears 100' thereinto. On removal of the flexuring force from the cap member 32 and its head portion 50, the spread apart cavity walls 92*a*, 92*b* and walls of the grooved recesses 102' then return toward but are prevented from fully returning to their normal unflexed state because of the larger size of the mounting ears 100' relative to the grooved recesses 102'. Instead, the cavity walls 92*a*, 92*b* and the walls of the grooved recesses 102' remain in a partially returned, deformed condition resiliently engaging and forcibly pressing tightly around the mounting ears 102' and against the immediately adjacent portions of the inner legs 74 of the clip 34', to thereby firmly support and rigidly hold the clip in place in the cavity 52 in axial alignment With the cap member 32** and against any rocking movement therein.

The modified form of the invention illustrated in FIGS. 9–14 is preferred over that shown in FIGS. 2–8 mainly because of the somewhat greater leverage afforded thereby on the pinch pad portion 122' of the clip member 34' by the tool employed to bend the pinch pad portion and press the bared wire end 44 against the grip tab portion 120' of the clip member. This added leverage enables a tighter clamping of the bared wire end 44 of the conductor 36 between the grip tab and pinch pad portions 120' and 122' of the clip member, which thus provides a more secure electrical connection of the conductor 36 to the clip member 34.

Having thus described the invention, it is claimed:

1. An anode connector assembly for electrically connecting a bared wire end of an insulated anode supply conductor to a standard anode button disposed in the glass envelope wall of a cathode ray tube, said assembly comprising a resilient cap having a center axis and a head portion with a flexible, axially extending, circular skirt portion protruding laterally outwardly therefrom, a U-shaped sheet metal connector clip firmly supported interiorly of said cap within the said head portion thereof and having spaced mounting legs extending from said head portion into and exposed within the spatial confines of said skirt portion for engaging the said anode button, and an anode supply conductor having a bared wire end extending into the said head portion of said cap, said clip being directly pinch clamped in situ to said bared wire end interiorly of said cap by a pinch pad portion of said clip to electrically connect it to said bared wire end.

2. An assembly according to claim 1, wherein the said mounting legs of the clip include inner leg portions extending in spaced parallel relation to one another within an open end axial cavity in the said head portion of said cap, intermediate leg portions offset laterally outward from said inner leg portions, and outer leg portions extending from said intermediate leg portions in generally parallel relation both to one another and to said inner leg portions and exposed within the spatial confines of the said skirt portion of said cap, said outer leg portions being provided at their outer ends with laterally outwardly protruding tab means to engage with said anode button.

3. An assembly according to claim 1, wherein the said head portion of said cap is provided with an axially extending cavity having a closed inner end and an open outer end facing axially outward of the open outer end of said circular skirt portion, said clip including inner leg portions extending in spaced parallel relation to one another and anchored in place in and extending outwardly of the open outer end of said cavity and intermediate leg portions extending outwardly from said inner leg portions and offset laterally outward therefrom, and an apertured metal shielding plate means surrounding said inner leg portions of said clip and interposed between the said intermediate leg portions and the end of said head portion bordering the said open end of the said cavity therein.

4. An anode connector assembly for electrically connecting a bared wire end of an insulated anode supply conductor to a standard anode button disposed in the glass envelope wall of a cathode ray tube, said assembly comprising a resilient cap having a center axis and a head portion with a flexible, axially extending, circular skirt portion protruding laterally outwardly therefrom, a U-shaped sheet metal connector clip firmly supported interiorly of said cap within the said head portion thereof and having spaced mounting legs extending from said head portion into and exposed within the spatial confines of said skirt portion for engaging the said anode button, and an anode supply conductor having a bared wire end extending into the said head portion of said cap, said clip being directly pinch clamped in situ to said bared wire end interiorly of said cap to electrically connect it thereto, said conductor wire end being pinch clamped between a grip tab portion and a pinch pad portion of said clip.

5. An assembly according to claim 4, wherein the said mounting legs of the clip include inner leg portions extending in spaced parallel relation to one another and supported in place in the said head portion of said cap, and the said grip tab and pinch pad portions each extend across substantially the entire spatial distance between the said parallel inner leg portions.

6. An assembly according to claim 4, wherein the said clip is provided with retaining means engaged with said pinch pad to retain it in wire clamping position.

7. An assembly according to claim 6, wherein the said retaining means comprises yieldable spring locking tang and snap-locked behind the said pinch pad portion to lock it in place in the said wire clamping position.

8. An assembly according to claim 7, wherein the said clip is anchored in a cavity in the said head portion of said cap and the said mounting legs of the clip include inner leg portions of flat shape extending in flatwise opposed spaced parallel relation to one another within said cavity, and the said locking tang means are located on the said inner leg portions of said mounting legs.

9. An assembly according to claim 8, wherein the said clip includes a base strip portion joined at its opposite ends to respective ones of said inner leg portions by doubled-back end loop extensions of said base strip portion constituting endwise projecting lock-in mounting ear portions on the clip fitted in and resiliently clamped by the walls of groove-shaped recesses in the side walls of said cavity to hold the clip in axial alignment with said cap and lock the clip in place in said cavity against movement outwardly therefrom.

10. An anode connector assembly for electrically connecting a bared wire end of an insulated anode supply conductor to a standard anode button disposed in the glass envelope wall of a cathode ray tube, said assembly comprising a resilient cap having a center axis and a head portion with a flexible, axially extending, circular skirt portion protruding laterally outwardly therefrom, a U-shaped sheet metal connector clip firmly support interiorly of said cap within the said head portion thereof and having spaced mounting legs extending from said head portion into and exposed within the spatial confines of said skirt portion for engaging the said anode button, and an anode supply conductor having a bared wire and extending into the said head portion of said cap, said clip being directly pinch clamped in situ to said bared wire end interiorly of said cap to electrically connect it thereto, the said head portion of said resilient cap being provided with an axial cavity within which the said clip is anchored in place, and the portion of the said clip anchored in said cavity being provided with laterally outwardly projecting mounting ear portions fitted in and resiliently clamped by the walls of recesses in the side walls of said cavity to hold the said clip in axial alignment with said cap and lock the clip in place in said cavity against movement outwardly therefrom.

11. An assembly according to claim 10, wherein the said clip includes a base strip portion and the said mounting legs of said clip are joined to said base strip portion by doubled-back end loop extensions thereof constituting the said mounting ear portions of the clip.

12. An anode connector assembly for electrically connecting a bared wire end of an insulated anode supply conductor to a standard anode button disposed in the glass envelope wall of a cathode ray tube, said assembly comprising a resilient cap having a head portion with a circular skirt portion protruding laterally outwardly therefrom, and a U-shaped sheet metal connector clip firmly supported in a cavity in the said head portion of said cap and having spaced mounting legs extending outwardly of an open end of said cavity and exposed within the confines of said skirt portion for engaging the said anode button, said clip including a base strip portion provided with grip tab and pinch pad portions extending angularly therefrom between the said mounting legs and in spaced overlapping relation with one another with the grip pad portion located between the base strip and pinch pad portions of the clip, and said cap having a laterally extending passageway communicating with said cavity for insertion of a said bared wire end of a said conductor through the said passageway and into said cavity in a position between the said mounting legs of the clip and between the said pinch pad and grip tab portions of the clip for clamping of the bared wire end between the said pinch pad and grip tab portions of the clip by bending of the pinch pad portion in a direction toward said grip tab portion into wire clamping position.

13. An assembly according to claim 12, wherein the said clip is provided with retaining means engageable with said pinch pad to retain the said pad in said wire clamping position.

14. An assembly according to claim 13, wherein the said mounting legs of the clip include inner leg portions extending in spaced parallel relation to one another and anchored in place in the said cavity in the said head portion of said cap, and the said grip tab and pinch pad portions each extend across substantially the entire spatial distance between the said parallel inner leg portions.

15. An assembly according to claim 13, wherein the said retaining means comprises yieldable spring locking tang means on at least one of said mounting legs and adapted to engage with and snap-lock behind the said pinch pad portion to lock it in place in the said wire clamping position thereof.

16. An assembly according to claim 15, wherein the said mounting legs of the clip include inner leg portions extending in spaced generally parallel relation to one another and anchored in place in the said cavity in the said head portion of said cap, and the said locking tang means are located on the said inner leg portions of said mounting legs.

17. An assembly according to claim 16, wherein the said base strip portion of the clip is joined at its opposite ends to respective ones of said inner leg portions by doubled-back end loop extensions of said base strip portion constituting endwise projecting lock-in mounting ear portions on the clip fitted in and resiliently clamped by the walls of groove-shaped recesses in the side walls of said cavity to hold the said clip in axial alignment with said cap and lock the clip in place in said cavity against movement outwardly therefrom.

18. An assembly according to claim 16, wherein the said locking tang means on the said inner leg portions of the mounting legs of said clip are comprised of tongue portions pressed out of the said inner leg portions and extending angularly inwardly therefrom in a direction toward the said base strip portion of the clip.

19. An assembly according to claim 12, wherein the portion of said clip supported in said cavity is provided with laterally outwardly projecting mounting ear portions fitted in and resiliently clamped by the walls of recesses in the side walls of said cavity to hold the said clip in axial alignment with said cap and lock the clip in place in said cavity against movement outwardly therefrom.

20. An assembly according to claim 19, wherein the said mounting legs of said clip are joined to the said base strip portion thereof by doubled-back end loop extensions of the base strip portion constituting the said mounting ear portions of the clip.

21. An assembly according to claim 12, wherein the said grip tab and pinch pad portions of said clip extend angularly from the said base strip portion thereof in generally opposite directions, and the said clip is axially oriented in the said cavity in said cap with the mouth opening between the said base strip portion and the free end of said pinch pad portion facing toward and communicating with the said laterally extending passageway in said cap.

22. An assembly according to claim 21, wherein the said clip is provided with retaining means engageable with said pinch pad portion on bending thereof into said wire clamping position, to thereby retain the said pinch pad portion in said wire clamping position.

23. An assembly according to claim 22, wherein the said retaining means comprises yieldable spring locking tang means on at least one of said mounting legs and adapted to engage with and snap-lock behind the said pinch pad portion to lock it in place in said wire clamping position.

24. An assembly according to claim 23, wherein the said mounting legs of the clip include inner leg portions extending in spaced generally parallel relation to one another and anchored in place in the said cavity in the said head portion of said cap, and the said locking tang means are located on the said inner leg portions of said mounting legs.

25. An assembly according to claim 24, wherein the said base strip portion of the clip is joined at its opposite ends to respective ones of said inner leg portions by doubled-back end loop extensions of said base strip portion constituting endwise projecting lock-in mounting ear portions on the clip fitted in and resiliently clamped by the walls of groove-shaped recesses in the side walls of said cavity to hold the said clip firmly in axial alignment with said cap and lock the clip in place in said cavity against movement outwardly therefrom.

26. An assembly according to claim 24, wherein the said locking tang means on the said inner leg portions of the mounting legs of said clip are comprised of tongue portions pressed out of the said inner leg portions and extending angularly inwardly therefrom in a direction toward the said base strip portion of the clip.

27. An assembly according to claim 21, wherein the portion of said clip supported in the said cavity in said head portion of said cap is provided with laterally outwardly projecting mounting ear portions fitted in and resiliently clamped by the walls of recesses in the side walls of said cavity to hold the said clip firmly in axial alignment with said cap and lock the clip in place in said cavity against movement outwardly thereof.

28. An assembly according to claim 27, wherein the said mounting legs of said clip are joined to the said base strip portion thereof by doubled-back end loop extensions of the base strip portion constituting the said mounting ear portions of the clip.

29. An assembly according to claim 12, wherein the said grip tab and pinch pad portions of said clip extend angularly from the said base strip portion thereof in generally the same direction but with the pinch pad portion extending at a shallower angle than said grip tab portion, and wherein the said clip is axially oriented in the said cavity in said cap with the mouth opening between the said base strip portion and the free end of said pinch pad portion facing away from the said conductor receiving passageway in said cap and with the U-bend bight portion of the pinch pad portion that joins the latter to said base strip portion disposed opposite and adjacent the open inner end of said passageway opening into said cavity, and with an aperture through the said U-bend bight portion of the pinch pad portion disposed opposite and in aligned communication with the said open inner end of said passageway for insertion of the said bared wire end of said conductor through said aperture and into clamping position between the grip tab and pinch pad portions of said clip.

30. An assembly according to claim 29, wherein the said clip is provided with retaining means engageable with said pinch pad portion on bending thereof into said wire clamping position, to thereby retain the said pinch pad portion in said wire clamping position.

31. An assembly according to claim 30, wherein the said retaining means comprises yieldable spring locking tang means on at least one of said mounting legs and adapted to engage with and snap-lock behind the said pinch pad portion to lock it in place in said wire clamping position.

32. An assembly according to claim 31, wherein the said mounting legs of the clip include inner leg portions extending in spaced generally parallel relation to one another and anchored in place in the said cavity in the said head portion of said cap, and the said locking tang means are located on the said inner leg portions of said mounting legs.

33. An assembly according to claim 32, wherein the said base strip portion of the clip is joined at its opposite ends to respective ones of said inner leg portions by doubled-back end loop extensions of said base strip portion constituting endwise projecting lock-in mounting ear portions on the clip fitted in, and resiliently clamped by the walls of groove-shaped recesses in the side walls of said cavity to hold the said clip firmly in axial alignment with said cap and lock the clip in place in said cavity against movement outwardly thereof.

34. An assembly according to claim 32, wherein the said locking tang means on the said inner leg portions of the mounting legs of said clip are comprised of tongue portions pressed out of the said inner leg portions and extending angularly inwardly therefrom in a direction toward the said base strip portion of the clip.

35. An assembly according to claim 29, wherein the portion of said clip supported in the said cavity in said head portion of said cap is provided with laterally outwardly projecting mounting ear portions fitted in and resiliently clamped by the walls of recesses in the side walls of said cavity to hold the said clip firmly in axial alignment with said cap and lock the clip in place in said cavity against movement outwardly thereof.

36. An assembly according to claim 35, wherein the said mounting legs of said clip are joined to the said base strip portion thereof by doubled-back end loop extensions of said base strip portion constituting the said mounting ear portions of the clip.

37. A metal connector device for mounting in a resilient cap member of an anode connector assembly to electrically connect a bared wire end of an insulated anode supply conductor to a standard anode button disposed in the side of a cathode ray tube, said connector device comprising a generally U-shaped one piece sheet metal clip including a flat base strip portion formed at its opposite ends with a pair of mounting legs extending in spaced side-by-side flatwise opposed relation on opposite sides of the transverse medial plane of and generally perpendicular to said base strip portion and adapted for engagement with said anode button, said base strip portion having a conductor grip tab pressed out and bent inwardly therefrom to extend at an acute angle relative thereto toward one of the side edges of the base strip portion and with its free end edge extending longitudinally of the base strip portion, and said base strip portion also having a conductor pinch pad portion extending from one of the side edges of said base strip portion and bent back to extend transversely inward of said clip between the said mounting legs and at an acute angle to said base strip portion, and toward and overlapping but in spaced relation to the free end edge of said grip tab, for deformation of the pinch pad portion toward said grip tab to tightly clamp a said bared conductor wire end between the pinch pad portion and the grip tab and electrically connect it to the clip.

38. A connector device according to claim 37, wherein the said mounting legs of the clip include inner leg portions extending generally parallel to one another and generally perpendicular to said base strip portion from inner ends immediately adjacent said base strip portion, and the said grip tab and pinch pad portions each extend across substantially the entire spatial distance between the said inner leg portions.

39. A connector device according to claim 37, wherein the said mounting legs are joined to the opposite ends of the said base strip portion by doubled back end loop extensions thereof constituting endwise projecting lock in mounting ears for the clip.

40. A connector device according to claim 37, wherein the said mounting legs are provided with retaining means engageable with the said deformed pinch pad to retain it in wire clamping position.

41. A connector device according to claim 40, wherein the said retaining means comprises yieldable spring locking tang means on at least one of said mounting legs and extending inwardly thereof at a shallow angle toward said base strip portion for engaging with and snap locking behind the said pinch pad portion to lock it in place in the said wire clamping position.

42. A connector device according to claim 41, wherein each one of the said pair of mounting legs is provided with a said spring locking tang means.

43. A connector device according to claim 41, wherein the said mounting legs of the clip include inner leg portions extending generally parallel to one another and generally perpendicular to said base strip portion from inner ends immediately adjacent said base strip portion, said inner leg portions being provided with said spring locking tang means, and the said grip tab and pinch pad portions each extending across substantially the entire spatial distance between the said inner leg portions.

44. A connector device according to claim 43, wherein the said locking tang means are comprised of tongue portions pressed out of the said inner leg portions of said clip.

45. A connector device according to claim 43, wherein the said inner leg portions of the mounting legs of said clip are joined to respective ends of the said base strip portion by doubled- back end loop extensions thereof constituting endwise projecting lock-in mounting ears for the clip.

46. A connector device according to claim 44, wherein the said mounting legs of the clip include inner leg portions extending generally parallel to one another and generally perpendicular to said base strip portion and joined to the opposite ends thereof by said doubled-back end loop extensions of the base strip portion.

47. A connector device according to claim 46, wherein the said end loop extensions are angularly bent down toward the adjacent mounting legs.

48. A connector device according to claim 46, wherein the said mounting legs further include intermediate leg portions offset laterally outward from said inner leg portions, and outer leg portions extending from said intermediate leg portions in generally parallel relation both to one another and to said inner leg portions and provided at their outer ends with laterally outwardly protruding tab means to engage with said anode button.

49. A connector device according to claim 37, wherein the said grip tab and pinch pad portions of said clip extend angularly from the said base strip portion thereof in generally opposite directions.

50. A connector device according to claim 49, wherein the said mounting legs of the clip include inner leg portions extending in generally parallel flatwise relation to one another and generally perpendicular to said base strip portion, and the said grip tab and pinch pad portions each extend across substantially the entire spatial distance between the said inner leg portions.

51. A connector device according to claim 49, wherein the said mounting legs are provided with retaining means engageable with the said deformed pinch pad to retain it in wire clamping position.

52. A connector device according to claim 51, wherein the said retaining means comprises yieldable spring locking tang means on at least one of said mounting legs and extending inwardly thereof at a shallow angle toward said base strip portion for engaging with and snap locking behind the said pinch pad portion to lock it in place in the said wire clamping position.

53. A connector device according to claim 52, wherein each one of the said pair of mounting legs is provided with a said spring locking tang means.

54. A connector device according to claim 52, wherein the said mounting legs of the clip include inner leg portions extending in generally parallel flatwise relation to one another and generally perpendicular to said base strip portion from inner ends immediately adjacent said base strip portion, said locking tang means being comprised of tongue portions pressed out of the said inner leg portions of the clip, and the said grip tab and pinch pad portions each extending across substantially the entire spatial distance between the said inner leg portions.

55. A connector device according to claim 54, wherein the said inner leg portions of the mounting legs of said clip are joined to respective ends of the said base strip portion by doubled-back end loop extensions thereof constituting endwise projecting lock-in mounting ears for the clip.

56. A connector device according to claim 49, wherein the said mounting legs are joined to the opposite ends of the said base strip portion by doubled back end loop extensions thereof constituting endwise projecting lock-in mounting ears for the clip.

57. A connector device according to claim 56, wherein the said mounting legs of the clip include inner leg portions extending generally parallel to one another and generally perpendicular to said base strip portion and joined to the opposite ends thereof by said doubled-back end loop extensions of the base strip portion.

58. A connector device according to claim 37, wherein the said grip tab and pinch pad portions of said clip extend angularly from the said base strip portion thereof in generally the same direction but with the pinch pad portion extending at a shallower angle than said grip tab portion and the grip tab portion being located between the base strip and pinch pad portions of the clip, and said pinch pad portion being joined to the said base strip portion by a U-bend bight portion provided with an aperture therethrough for passage of a said bared wire end of a conductor through said aperture into clamping position between the grip tab and pinch pad portions of the clip.

59. A connector device according to claim 58, wherein the said mounting legs of the clip include inner leg portions extending in generally parallel flatwise relation to one another and generally perpendicular to said base strip portion, and the said grip tab and pinch pad portions each extend across substantially the entire spatial distance between the said inner leg portions.

60. A connector device according to claim 58, wherein the said mounting legs are provided with retaining means engageable with the said deformed pinch pad to retain it in wire clamping position.

61. A connector device according to claim 60, wherein the said retaining means comprises yieldable spring locking tang means on at least one of said mounting legs and extending inwardly thereof at a shallow angle toward said base strip portion for engaging with and snap locking behind the said pinch pad portion to lock it in place in the said wire clamping position.

62. A connector device according to claim 61, wherein each one of the said pair of mounting legs is provided with a said spring locking tang means.

63. A connector device according to claim 61, wherein the said mounting legs of the clip include inner leg portions extending in generally parallel flatwise relation to one another and generally perpendicular to said base strip portion from inner ends immediately adjacent said base strip portion, said locking tang means being comprised of tongue portions pressed out of the said inner leg portions of the clip, and the said grip tab and pinch pad portions each extending across substantially the entire spatial distance between the said inner leg portions.

64. A connector device according to claim 63, wherein the said inner leg portions of the mounting legs of said clip are joined to respective ends of the said base strip Portion by doubled-back end loop extensions thereof constituting endwise projecting lock-in mounting ears for the clip.

65. A connector device according to claim 58, wherein the said mounting legs are joined to the opposite ends of the said base strip portion by doubled back end loop extensions thereof constituting endwise projecting lock-in mounting ears for the clip.

66. A connector device according to claim 65, the said mounting legs of the clip include inner leg portions extending generally parallel to one another and generally perpendicular to said base strip portion and joined to the opposite ends thereof by said doubled back end loop extensions of the base strip portion.

67. The method of assembling the components of an anode connector assembly comprised of a resilient shielding cap with a metal connector clip anchored within a cavity therein, and an electrical conductor supported within a passageway in said cap leading into the said cavity therein and having a bared wire end electrically connected to the clip, which method comprises the steps of providing a said metal clip having a grip tab portion and a pinch pad portion located adjacent and overlapping but spaced from said grip tab portion, inserting the said clip into and firmly anchoring it in place in the said cavity in said cap, inserting a bared wire end of a said conductor into and threading it through the said passageway in said cap and into the said cavity therein into a position located between the said grip tab and pinch pad portions of the said clip anchored in said cavity, and then inserting a press tool into the said cavity into engagement with the said pinch pad portion of the clip anchored therein and forcibly pressing said tool against the pinch pad toward the grip tab to deform the pinch pad so as to pinch the said positioned bared wire end of said conductor between the pinch pad and grip tab and thereby electrically connect it to the clip.

* * * * *